US010222039B2

(12) United States Patent
Ando et al.

(10) Patent No.: US 10,222,039 B2
(45) Date of Patent: Mar. 5, 2019

(54) LUMINAIRE

(71) Applicant: Panasonic Intellectual Property Management Co., Ltd., Osaka (JP)

(72) Inventors: Tamotsu Ando, Osaka (JP); Shigeo Goto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 243 days.

(21) Appl. No.: 15/013,197

(22) Filed: Feb. 2, 2016

(65) Prior Publication Data

US 2016/0245492 A1 Aug. 25, 2016

(30) Foreign Application Priority Data

Feb. 23, 2015 (JP) ..... 2015-033271

(51) Int. Cl.
*F21V 23/02* (2006.01)
*F21V 21/02* (2006.01)
(Continued)

(52) U.S. Cl.
CPC ..... *F21V 23/023* (2013.01); *F21V 21/02* (2013.01); *F21Y 2103/10* (2016.08);
(Continued)

(58) Field of Classification Search
CPC ..... F21V 23/023; F21V 23/02; F21V 21/02
See application file for complete search history.

(56) References Cited

U.S. PATENT DOCUMENTS

2012/0268343 A1* 10/2012 Yanagi ..... H01Q 1/526 343/872
2013/0181607 A1* 7/2013 Yotsumoto ..... H05B 37/0272 315/70
(Continued)

FOREIGN PATENT DOCUMENTS

JP 08-321388 A 12/1996
JP 2007-227041 9/2007
(Continued)

OTHER PUBLICATIONS ip.com search (Year: 2018).*

*Primary Examiner* — Diane I Lee
*Assistant Examiner* — Naomi M Wolford
(74) *Attorney, Agent, or Firm* — Renner, Otto, Boisselle & Sklar, LLP

(57) ABSTRACT

A luminaire includes a light source having a light-emitting element, and a communication device configured to transmit and/or receive a communication signal by wireless communication. The luminaire further includes a power supply configured to supply electric power to the light source and the communication device, and a housing configured to contain the communication device and the power supply. The light source is configured to be held by the housing. The housing is provided with an opening. The housing has a rectangular parallelepiped shape with electrically conductive walls to form a rectangular waveguide having a cutoff frequency. The housing is set to have a dimension in a width direction thereof such that a radio frequency of the communication signal is equal to or more than the cutoff frequency.

16 Claims, 6 Drawing Sheets

(51) Int. Cl.

| | |
|---|---|
| *F21Y 113/00* | (2016.01) |
| *F21Y 115/30* | (2016.01) |
| *F21Y 103/10* | (2016.01) |
| *F21Y 115/10* | (2016.01) |
| *F21Y 115/15* | (2016.01) |

(52) U.S. Cl.
CPC ..... *F21Y 2113/00* (2013.01); *F21Y 2115/10* (2016.08); *F21Y 2115/15* (2016.08); *F21Y 2115/30* (2016.08)

(56) References Cited

U.S. PATENT DOCUMENTS

| | | | | |
|---|---|---|---|---|
| 2014/0218913 | A1* | 8/2014 | Cozzolino | F21S 8/04 362/235 |
| 2015/0345754 | A1* | 12/2015 | Sohn | F21V 17/12 362/222 |
| 2016/0223153 | A1* | 8/2016 | Van Dijk | F21S 8/03 |

FOREIGN PATENT DOCUMENTS

| | | | |
|---|---|---|---|
| JP | 2012-174454 | A | 9/2012 |
| JP | 2013-033652 | A | 2/2013 |
| JP | 2014-150032 | A | 8/2014 |

* cited by examiner

LUMINAIRE

CROSS-REFERENCE TO RELATED APPLICATIONS

The application is based upon and claims the benefit of priority of Japanese Patent Application No. 2015-033271, filed on Feb. 23, 2015, the entire content of which is incorporated herein by reference.

TECHNICAL FIELD

The present disclosure relates to a luminaire.

BACKGROUND ART

Conventionally, there is proposed an illuminating system including a plurality of luminaires, a plurality of sensor parts and an operation unit (for example, refer to JP 2013-33652 A (hereinafter referred to as "Document 1")).

Each of the plurality of luminaires in the illuminating system described in Document 1 includes a light source, a housing, a lighting circuit, a controller and a radio part. The housing is formed of metal.

The housing is provided inside thereof with an antenna configuring the radio part. Innumerous through holes are provided in the housing. The antenna is arranged at a position where it can be viewed from any of the through holes.

It is described in Document 1 that the antenna is arranged at the position where it can be viewed from any of the through holes and accordingly signals for wireless communication (for receiving) to the antenna can avoid being shielded by the housing.

There is a demand for miniaturizing this type of luminaire. However, if a miniaturization of each of the plurality of luminaires in the illuminating system described in Document 1 is considered, it may be difficult to arrange the antenna in a vicinity of any of the through holes, which may possibly cause deterioration in communication performance.

SUMMARY

The present disclosure is directed to a luminaire, which can improve a flexible arrangement for a communication device and prevent deterioration in communication performance.

A luminaire of an aspect according to the present disclosure includes a light source with a light-emitting element, and a communication device configured to transmit and/or receive a communication signal by wireless communication. The luminaire further includes a power supply configured to supply electric power to the light source and the communication device, and a housing configured to contain the communication device and the power supply. The light source is configured to be held by the housing. The housing is provided with an opening. The housing has a rectangular parallelepiped shape with electrically conductive walls to form a rectangular waveguide having a cutoff frequency. The housing is set to have a dimension in a width direction thereof such that a radio frequency of the communication signal is equal to or more than the cutoff frequency.

BRIEF DESCRIPTION OF THE DRAWINGS

The figures depict one or more implementations in accordance with the present disclosure, by way of example only, not by way of limitations. In the figures, like reference numerals refer to the same or similar elements.

DETAILED DESCRIPTION

Following embodiments relate generally to luminaires and, more particularly, to a luminaire capable of wireless communication.

Embodiment 1

Hereinafter, a luminaire 10 of Embodiment 1 will be described with reference to FIGS. 1 to 3.

For example, the luminaire 10 is configured to be directly attached to a ceiling member 90. The luminaire 10 includes, for example, a light source unit 1 and a luminaire body 2.

Figure 2:
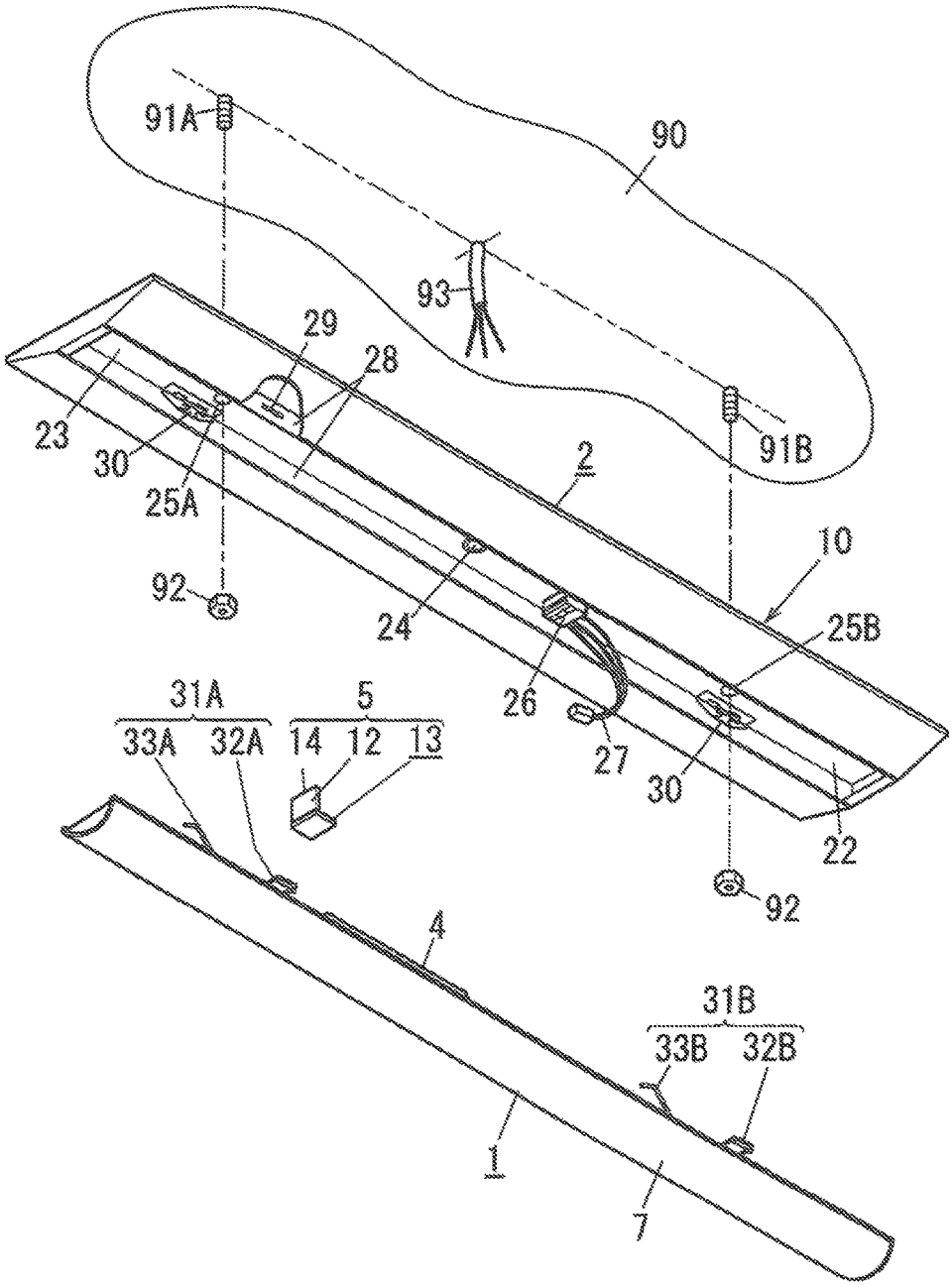
FIG. 2 is an exploded perspective view of the luminaire according to Embodiment 1.

The light source unit 1 includes, for example, a light source 3, a power supply 4, a communication device 5, an attachment member 6, a cover 7 and fixtures 31A and 31B which are paired (refer to FIG. 2).

The light source 3 includes a plurality of light-emitting elements 8 and a substrate 9 that is electrically connected to the plurality of light-emitting elements 8.

The plurality of light-emitting elements 8 may be, for example, LEDs (light-emitting diodes). For example, the plurality of light-emitting elements 8 are connected in series. The plurality of light-emitting elements 8 may be the LEDs, but may also be, for example, organic electroluminescence elements, semiconductor laser elements or the like.

The substrate 9 may be, for example, a printed substrate. The plurality of light-emitting elements 8 are arranged on a surface (a lower surface in FIG. 1) of the substrate 9. The substrate 9 is not limited to the printed substrate, but may be, for example, a ceramic substrate or the like. In FIG. 1, a thickness direction of the ceiling member 90 is defined as a vertical direction.

The light source 3 may include, for example, two or more substrates 9.

The two or more substrates 9 are arranged in a straight line. The two or more substrates 9 are configured to be electrically connected to each other. The two or more substrates 9 are also configured to be attached to the attachment member 6.

The power supply 4 is configured to supply electric power to the light source 3 and the communication device 5. The power supply 4 includes, for example, a power supply substrate (not shown) having a power supply circuit configured to supply electric power to the light source 3 and the communication device 5, and a casing 11 configured to contain the power supply substrate.

For example, the power supply circuit is configured to convert an AC voltage into a DC voltage. The power supply circuit is electrically connected to a connection wire 27 described below (refer to FIG. 2).

For example, the casing 11 is formed in a shape of a rectangular box of which a lower surface (a surface facing downward from the ceiling member 90) is open. The casing 11 is formed, for example, of metal.

The casing 11 is provided with a first hole through which the connection wire 27 is inserted. The casing 11 is also provided with attachment pieces for attaching the casing 11 to the attachment member 6. In other words, the casing 11 is provided with the attachment pieces for attaching the power supply 4 to the attachment member 6. That is, the power supply 4 is configured to be attached to the attachment member 6.

For example, the communication device 5 is configured to transmit/receive a communication signal by wireless communication using a radio wave as a medium. For example, a low-power data communication system in a 2.4 GHz band (e.g., from 2400 MHz to 2483.5 MHz) is used for the communication device 5 as the wireless communication. The low-power data communication system in the 2.4 GHz band is used for the communication device 5 as the wireless communication, but not limited to this, for example, a specific low-power wireless communication in a 920 MHz band may also be used. The 920 MHz band is a frequency band for a flexible use without requiring qualification or license, as a specific low-power wireless in Japan, in addition to the 2.4 GHz band, and is a frequency band from 915 MHz to 928 MHz around 920 MHz, for example. Alternatively, as another example of the 920 MHz band, a specific low-power wireless communication in a band from 902 MHz to 928 MHz may be used. The band from 902 MHz to 928 MHz is a frequency band for a flexible use without requiring qualification or license, as a specific low-power wireless in North America. Alternatively, as yet another example of the 920 MHz band, a specific low-power wireless communication in a band from 920.5 MHz to 924.5 MHz may be used. The band from 920.5 MHz to 924.5 MHz is a frequency band for a flexible use without requiring qualification or license, as a specific low-power wireless in China.

The communication device 5 includes an antenna 12, a communication substrate 13 having a communication circuit and a substrate 14.

The antenna 12 is for transmitting and/or receiving the communication signal. For example, the antenna 12 is formed on a surface (a left surface in FIG. 2) of the substrate 14. The substrate 14 may be, for example, a printed substrate.

The antenna 12 is electrically connected to the communication circuit. The substrate 14 is fixed to the communication substrate 13.

The communication circuit of the communication substrate 13 is configured to be able to transmit/receive a communication signal via the antenna 12. To be more specific, the communication circuit of the communication substrate 13 is configured to be able to transmit a communication signal to the antenna 12. The communication circuit of the communication substrate 13 is also configured to be able to receive a communication signal received by the antenna 12.

The communication device 5 is configured to have a function of transmitting and receiving the communication signal, but not limited to this configuration. For example, the communication device 5 may be configured to have only a function of transmitting the communication signal via the antenna 12. Alternatively, for example, the communication device 5 may be configured to have only a function of receiving the communication signal via the antenna 12.

The communication device 5 is configured to include the antenna 12, the communication substrate 13 and the substrate 14, but not limited to this configuration. For example, the communication device 5 may be configured to further include a box for containing the antenna 12, the communication substrate 13 and the substrate 14. For example in this case, the box is configured so that the medium (the radio wave) of the wireless communication used for the communication device 5 can be transmitted through the box. For example, the box is formed of synthetic resin.

The antenna 12 is formed on the substrate 14, but not limited to this, for example, may be formed with a metal wire. In this case, the antenna 12 is fixed to the communication substrate 13.

The attachment member 6 is configured to be attached with the light source 3, the power supply 4 and the communication device 5. For example, the attachment member 6 is formed with a metal plate.

The attachment member 6 includes a bottom plate 16 having a square shape or a rectangular shape, and side plates 17A and 17B which are paired.

The light source 3 is arranged on a surface (a lower surface in FIG. 1) of the bottom plate 16.

For example, the bottom plate 16 is provided with two or more first holding pieces (not shown). The two or more first holding pieces are configured to hold the two or more substrates 9. The two or more first holding pieces are formed by parts of the bottom plate 16 being cut and raised from the bottom plate 16.

The power supply 4 is arranged on a back surface (an upper surface in FIG. 1) of the bottom plate 16.

For example, the bottom plate 16 is provided with two or more second holding pieces (not shown). The two or more second holding pieces are configured to respectively hold the attachment pieces of the casing 11. The two or more second holding pieces are formed by parts of the bottom plate 16 being cut and raised from the bottom plate 16.

The communication device 5 is arranged on the side of the back surface of the bottom plate 16 so that a base 19 is disposed between the communication device 5 and the back surface. To be more specific, the communication substrate 13 is arranged on the side of the back surface of the bottom plate 16 so that the base 19 is disposed between the communication substrate 13 and the back surface.

For example, the base 19 is formed in a shape of a rectangular plate. For example, the base 19 has electrical insulation. For example, the base 19 is formed of synthetic resin or the like.

Figure 1:
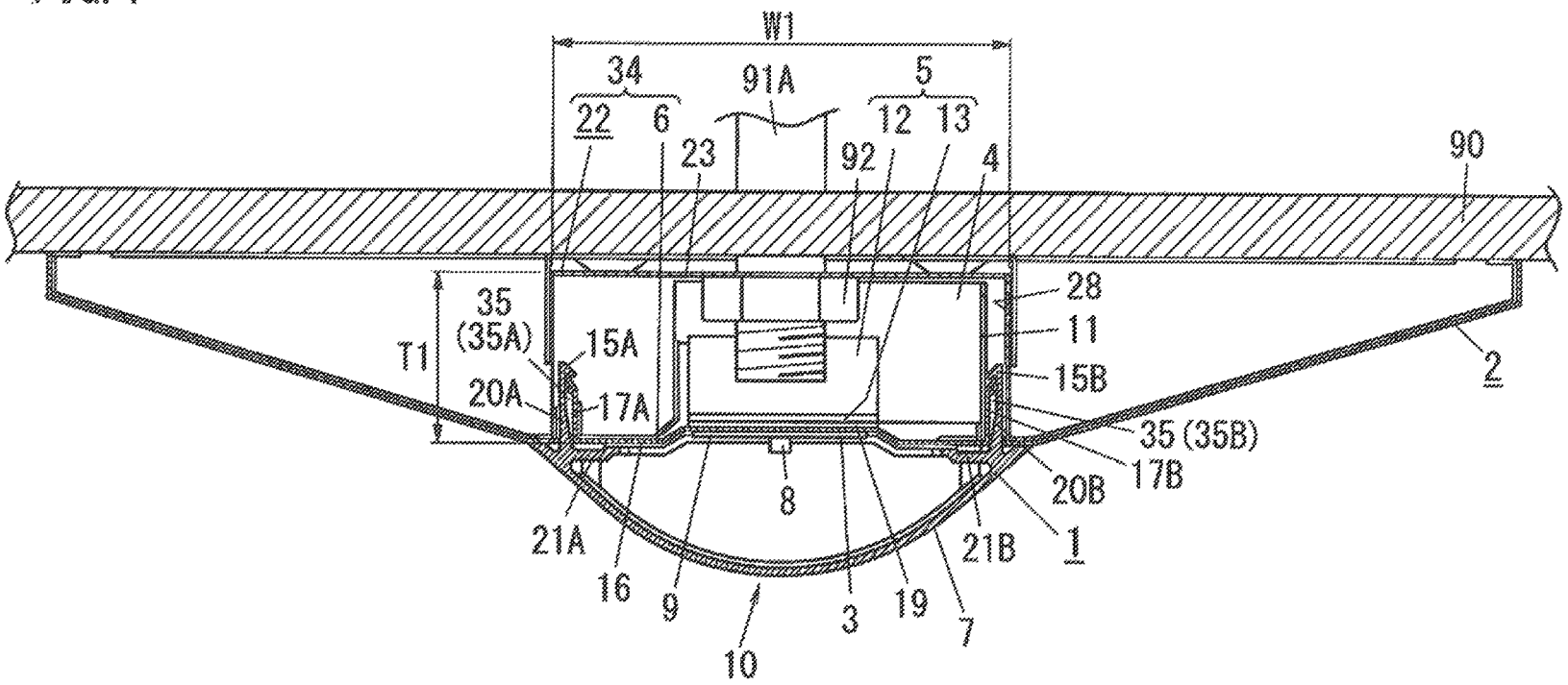
FIG. 1 is a sectional view of a luminaire attached to a ceiling member according to Embodiment 1.

The side plates 17A and 17B paired are protruded at both ends of the bottom plate 16 in a direction orthogonal to a thickness direction of the bottom plate 16 (in a right-left direction in FIG. 1). To be more specific, the side plates 17A and 17B paired are protruded upward at both ends of the bottom plate 16 in a width direction of the bottom plate 16 (in the right-left direction in FIG. 1). Each of the side plates 17A and 17B paired is provided over an entire length in a longitudinal direction, of the bottom plate 16.

The cover 7 is configured to cover the light source 3. The cover 7 is configured to be attached to the attachment member 6.

For example, the cover 7 serves as a diffuser. For example, the cover 7 is formed of milky white acrylic resin.

For example, the cover 7 is formed to have a convex surface protruding toward a direction (a lower side in FIG. 1) in which an outer surface of the cover 7 is apart from the light source 3. For example, the cover 7 is formed to have a concave surface recessing toward a direction in which an inner surface of the cover 7 is apart from the light source 3.

The cover 7 is provided with a pair of projecting walls 20A and 20B projecting upward at both ends along the width direction, of the bottom plate 16. The projecting wall 20A is provided with a projection 15A which can be hooked on the side plate 17A. The projecting wall 20B is provided with a projection 15B which can be hooked on the side plate 17B.

The cover 7 is further provided with a pair of supporting pieces 21A and 21B for supporting the bottom plate 16 at the both ends along the width direction, of the bottom plate 16.

Fixtures 31A and 31B paired (refer to FIG. 2) is configured to attach the light source unit 1 to the luminaire body 2. For example, each of the fixtures 31A and 31B paired is formed of metal.

The fixture 31A includes a hooking piece 32A and a hooking spring 33A. The fixture 31B includes a hooking piece 32B and a hooking spring 33B.

Each of two hooking pieces 32A and 32B is fixed to one end in the width direction, of the bottom plate 16.

Each of two hooking springs 33A and 33B is fixed to the other end in the width direction, of the bottom plate 16.

The luminaire body 2 is configured to be attached detachably to the light source unit 1. That is, the light source unit 1 attached with the bottom plate 16 is attached detachably to the luminaire body 2 with the fixtures 31A and 31B paired, of the bottom plate 16. For example, the luminaire body 2 is configured to be directly attached to the ceiling member 90 by being attached to a pair of hanging bolts 91A and 91B (refer to FIG. 2) derived from the ceiling member 90 with two nuts 92 and 92 (refer to FIG. 2).

The luminaire body 2 is formed into a shape of a long flat box of which upper surface is open, for example, by means of applying bending and the like for a metal plate.

The luminaire body 2 is provided with a recess 22 in which the attachment member 6 is arranged. In other words, the luminaire body 2 is provided with the recess 22 in which the light source unit 1 is arranged. The recess 22 is configured by an upper wall 23 and an inner peripheral wall 28.

For example, the upper wall 23 is provided with a second hole 24 through which a power supply wire 93 (refer to FIG. 2) derived from the ceiling member 90 is inserted. The upper wall 23 is further provided with third holes 25A and 25B paired, through which the hanging bolts 91A and 91B paired are respectively inserted. The upper wall 23 is further provided with a terminal block 26. Note that the power supply wire 93 is electrically connected to an external power supply. The external power supply may be, for example, a commercial power supply.

The terminal block 26 is configured to be electrically and automatically connected to the power supply wire 93 pulled out through the second hole 24. The terminal block 26 is electrically connected to the connection wire 27 for electrically connecting the terminal block 26 with the light source unit 1.

Two fourth holes 29 and 29 are provided in the inner peripheral wall 28. Note that one of the two fourth holes 29 and 29 is shown in FIG. 2.

The two fourth holes 29 and 29 are configured so that the two hooking pieces 32A and 32B can be hooked therein.

Two fifth holes 30 and 30 are also provided in the inner peripheral wall 28. The two fifth holes 30 and 30 are configured so that the two hooking springs 33A and 33B can be hooked therein.

Regarding the luminaire 10, the attachment member 6 and the recess 22 constitute a housing 34 (refer to FIG. 1). For example, the housing 34 has an outer peripheral shape of a rectangular when viewed from a longitudinal direction thereof.

The housing 34 is configured to contain the power supply 4 and the communication device 5. The housing 34 is configured to hold the light source 3.

The housing 34 is formed to have a rectangular parallelepiped outer shape with a plate member having electrical conductivity so that the communication signal is propagated. The housing 34 is provided with two openings 35 (a first opening 35A and a second opening 35B), as shown in FIGS. 1 and 3. The housing 34 is further set to have a dimension W1 (refer to FIG. 1) in a width direction thereof such that a radio frequency of the communication signal is equal to or more than a cutoff frequency. The plate member having electrical conductivity may be, for example, a metal plate or the like. That is, the housing 34 is used for the luminaire 10 as a waveguide which propagates the communication signal.

To be more specific, an opening 35 is provided between the inner peripheral wall 28 of the recess 22 and each of the side plates 17A and 17B paired. The dimension W1 in the width direction, of the housing 34, is set larger than a dimension T1 (refer to FIG. 1) in a thickness direction, of the housing 34. In the case where the low-power data communication system in the 2.4 GHz band is used, the housing 34 is formed such that the dimension W1 in the width direction thereof is equal to or more than 0.06 meter [m]. Alternatively, in the case where the low-power data communication system in the 920 MHz band is used, the housing 34 is formed such that the dimension W1 is equal to or more than 0.16 [m]. Regarding the luminaire 10, because the cover 7 is formed of the acrylic resin, the openings 35 (refer to FIGS. 1 and 3) are configured by: space formed when attaching the light source unit 1 to the luminaire body 2 (between the inner peripheral wall 28 of the recess 22 and each of the side plates 17A and 17B paired); and the pair of projecting walls 20A and 20B. Accordingly, for example in the luminaire 10, the communication signal from the antenna 12 can be transmitted through the two openings 35 (the first opening 35A and the second opening 35B) of the housing 34 serving as the waveguide. That is, wireless communication can be performed in the luminaire 10. In the present embodiment, the number of the openings 35 is two, but may be one (either the first opening 35A or the second opening 35B) or equal to or more than three. Alternatively, one opening may be formed as a space along the entire circumference of the inner peripheral wall 28 of the recess 22.

Figure 3:
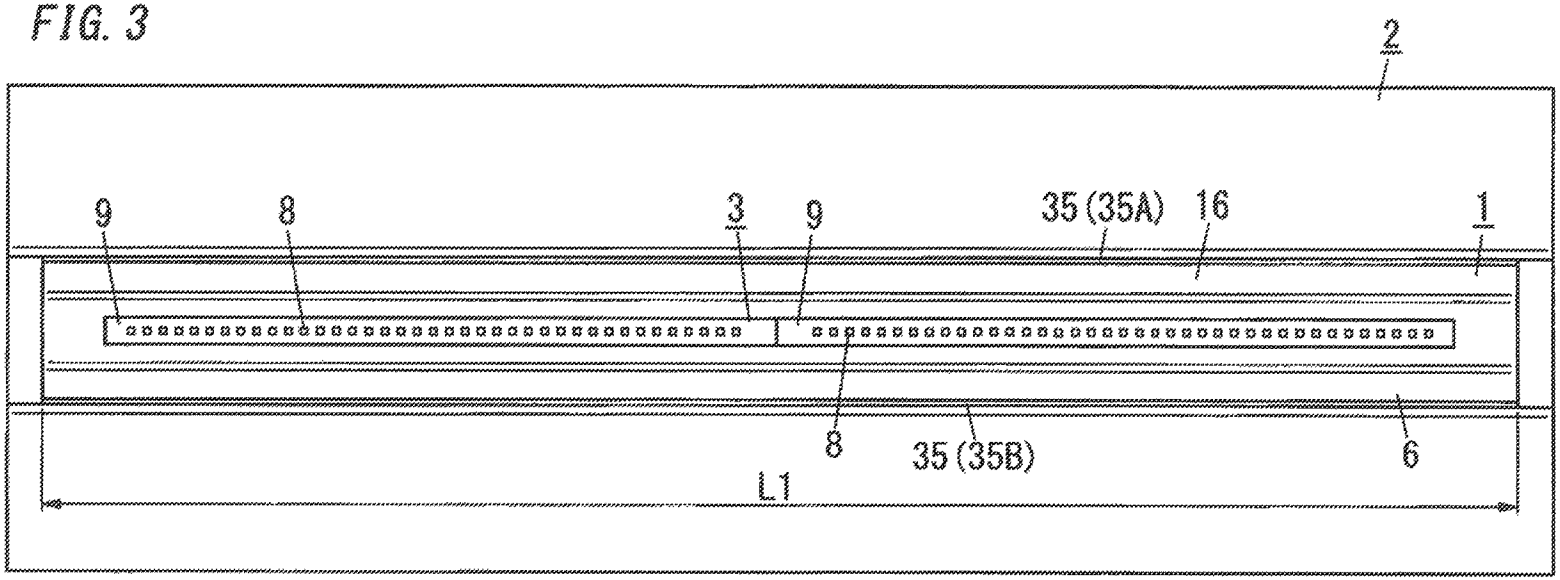
FIG. 3 is a schematic plan view of a light source unit from which a cover is removed, in the luminaire according to Embodiment 1.

In the present embodiment, a longitudinal direction of a general waveguide corresponds to a longitudinal direction of the housing 34 (corresponds to a longitudinal direction of the attachment member 6 in FIG. 3). The housing 34 is formed as a metallic hollow waveguide in a rectangular parallelepiped shape, and the opening 35 each is set to have a dimension L1 (refer to FIG. 3) in the longitudinal direction that is equal to or more than ½λc when a cutoff wavelength of the cutoff frequency is λc. For example, when the low-power data communication system in the 2.4 GHz band is used, the cutoff wavelength of the cutoff frequency (2.4 GHz) of the waveguide (the housing 34) is $3\times10^8$ (a speed of light)/$2.4\times10^9$=0.125 [m]. Therefore, the opening 35 each is set to have the dimension L1 in the longitudinal direction that is equal to or more than 0.125 [m]/2=0.0625 [m]. Note that in this example, it is most preferable that the dimension L1 be set to 0.0625 [m], but even if more than 0.0625 [m], the housing 34 functions as a waveguide.

The communication device 5 is arranged apart from the opening 35 inside the housing 34 (refer to FIG. 1). That is, in the width direction of the housing 34, the communication device 5 is arranged in the middle of the first opening 35A and the second opening 35B. The communication device 5 is arranged apart from the opening 35 inside the housing 34, but not limited to this, the communication device 5 may be arranged in a vicinity of one opening 35.

Regarding the luminaire 10, the housing 34 has the rectangular parallelepiped shape with electrically conductive walls to form a rectangular waveguide having a cutoff frequency, and set to have the dimension W1 in the width direction thereof such that the radio frequency of the communication signal is equal to or more than the cutoff frequency. Accordingly, the luminaire 10 can more improve a flexible arrangement for the communication device 5, compared to each luminaire in a conventional illuminating system described in the above-mentioned Document 1. Furthermore, even if the communication device 5 is arranged apart from the openings 35, the luminaire 10 can better prevent deterioration in the communication performance, compared to each luminaire in the conventional illuminating system described in the above-mentioned Document 1. In luminaire 10, even if the housing 34 does not function as a waveguide by the communication device 5 being arranged in a vicinity of one opening 35, the communication signal from the antenna 12 can be transmitted through the one opening 35.

It is preferable that the opening 35 each have a slit-like opening shape. Accordingly, in the luminaire 10, a periphery of the opening 35 in the housing 34 can serve as a slot antenna for a waveguide. As a result, deterioration in the communication performance can be further prevented in the luminaire 10.

Figure 4:
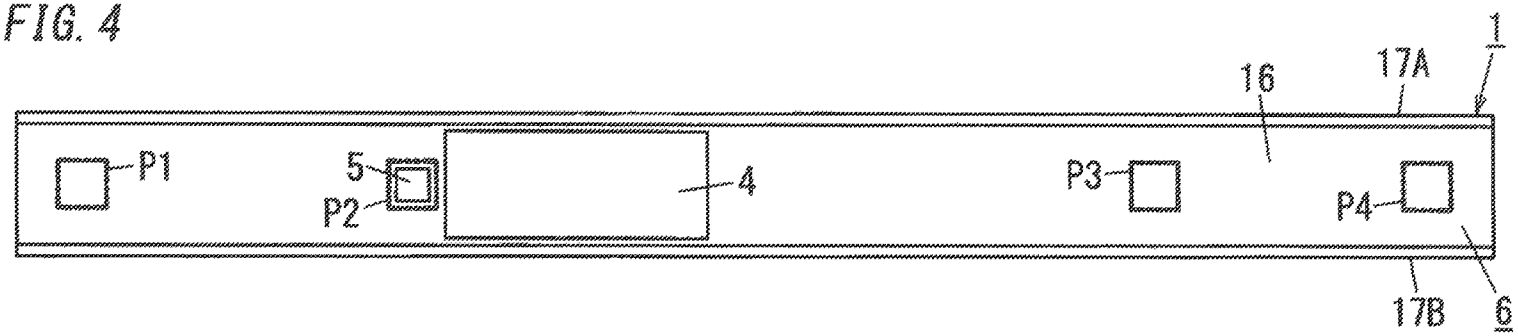
FIG. 4 is an explanation view illustrating an arrangement example when arranging a communication device at various positions on an attachment member, in the luminaire according to Embodiment 1.
Figure 5:
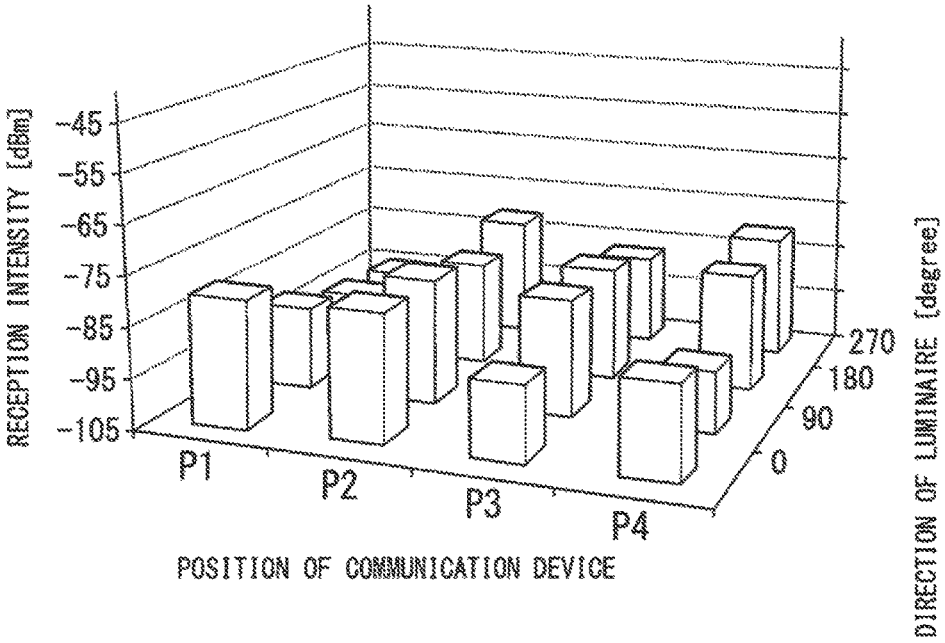
FIG. 5 is a graph illustrating a reception intensity of a radio wave emitted from the communication device, when arranging: the communication device at the various positions on the attachment member; and an antenna perpendicular to the attachment member, in the luminaire according to Embodiment 1.
Figure 6:
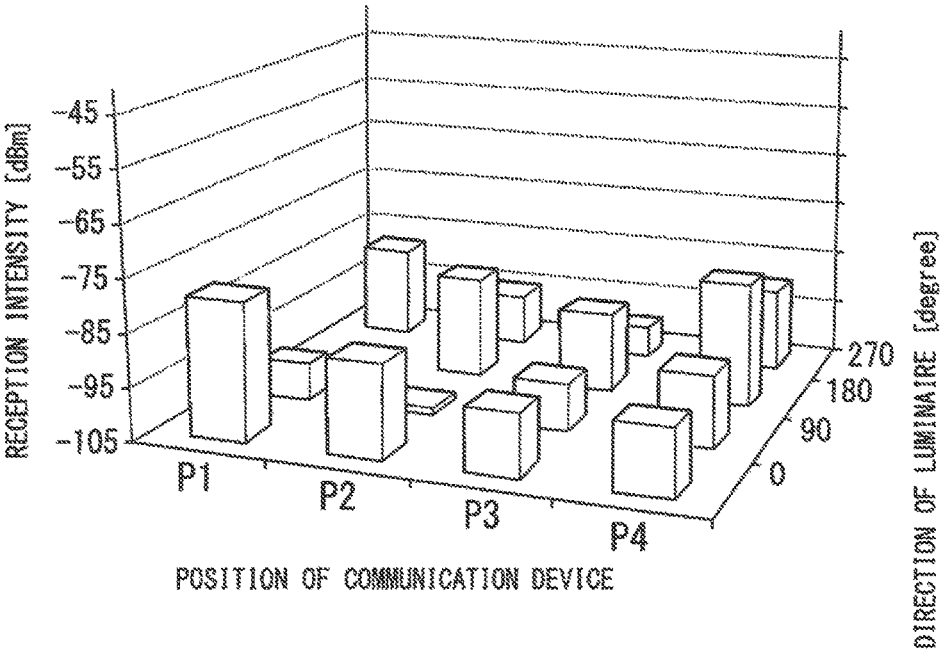
FIG. 6 is a graph illustrating a reception intensity of the radio wave emitted from the communication device, when arranging: the communication device at the various positions on the attachment member; and the antenna horizontally to the attachment member, in the luminaire according to Embodiment 1.

Regarding the luminaire 10, the inventors of the present application obtained measurement results shown in FIGS. 5 and 6 (graphs) by measuring a reception intensity of a radio wave emitted from the communication device 5 when arranging the communication device 5 at various positions on the attachment member 6 (P1 to P4 in FIG. 4). FIG. 5 shows the graph when arranging the substrate 14 on which the antenna 12 is formed so that a surface of the substrate 14 is perpendicular to the bottom plate 16 of the attachment member 6. In other words, FIG. 5 shows the graph when a thickness direction of the substrate 14 is orthogonal to a thickness direction of the communication substrate 13. FIG. 6 shows the graph when arranging the substrate 14 so that the surface of the substrate 14 is parallel to the bottom plate 16. In other words, FIG. 6 shows the graph when the thickness direction of the substrate 14 is the same as the thickness direction of the communication substrate 13. FIGS. 5 and 6 show the graphs when using the low-power data communication system in the 2.4 GHz band as the wireless communication. Hereinafter, for convenience of explanation, when the substrate 14 is arranged so that the surface thereof is perpendicular to the bottom plate 16, it may be simply referred to also as "when the substrate 14 is arranged vertically". In addition hereinafter, for convenience of explanation, when the substrate 14 is arranged so that the surface thereof is horizontal to the bottom plate 16, it may be simply referred to also as "when the substrate 14 is arranged horizontally".

Figure 7:
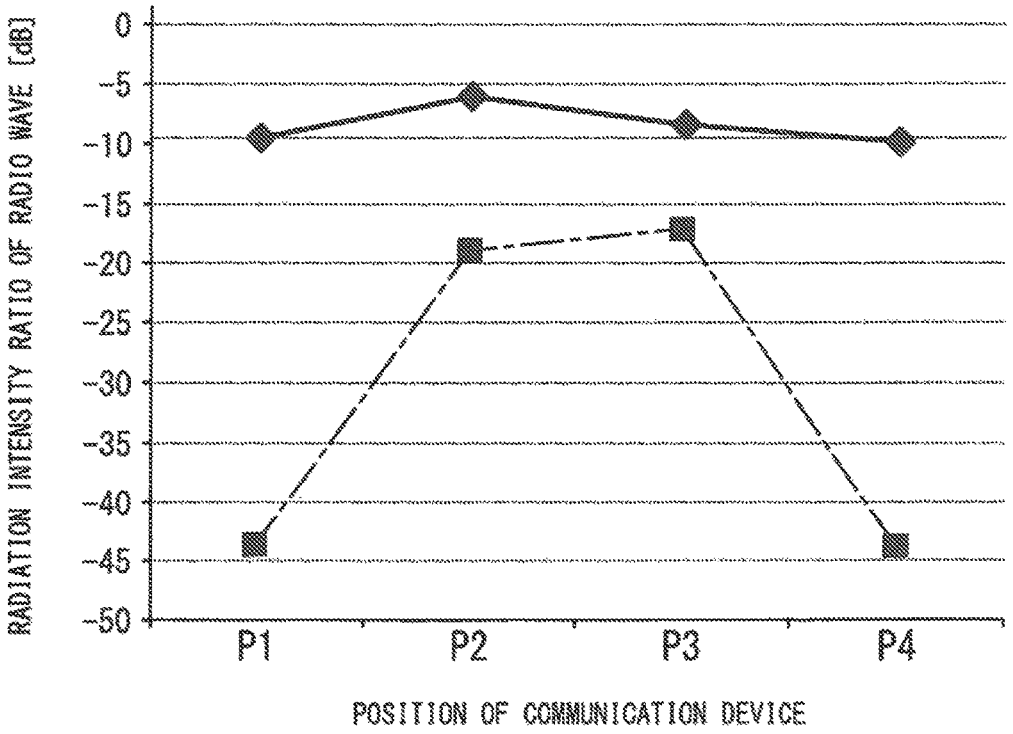
FIG. 7 is a graph illustrating a radiation intensity ratio of the radio wave from the communication device when arranging the communication device at the various positions on the attachment member, in the luminaire according to Embodiment 1.

Further, regarding the luminaire 10, the inventors of the present application measured radiation intensity of the radio wave emitted from the communication device 5 when arranging the communication device 5 at the various positions on the attachment member 6 (P1 to P4 in FIG. 4). Moreover, regarding the luminaire 10, the inventors of the present application obtained a measurement result shown in FIG. 7 (the radiation intensity ratio of the radio wave from the communication device 5) by comparing the radiation intensity of the radio wave emitted from the communication device 5 with radiation intensity of a radio wave emitted from a standard dipole antenna. Note that, the radiation intensity ratio of the radio wave from the communication device 5 means the radiation intensity of the radio wave emitted from the communication device 5 when using, as a reference, the radiation intensity of the radio wave emitted from the standard dipole antenna. In FIG. 7, a solid line of a graph shows the radiation intensity ratio of the radio wave from the communication device 5 when arranging the substrate 14 vertically. In FIG. 7, a dashed line of the graph shows the radiation intensity ratio of the radio wave from the communication device 5 when arranging the substrate 14 horizontally. FIG. 7 shows the graph when using the low-power data communication system in the 2.4 GHz band as the wireless communication.

From the graphs shown in FIGS. 5 and 6, the inventors of the present application considered it is preferable that the substrate 14 be arranged vertically. From the graph shown in FIG. 5, the inventors of the present application further considered it is preferable that the communication device 5 be arranged adjacent to the power supply 4 (P2 in FIG. 4). Moreover, as shown in FIG. 7, the inventors of the present application obtained a result that the radiation intensity ratio of the radio wave from the communication device 5 when arranging the substrate 14 vertically is higher than that when arranging the substrate 14 horizontally. In addition, as shown in FIG. 7, the inventors of the present application obtained a result that variations of the radiation intensity ratio of the radio wave from the communication device 5 when arranging the substrate 14 vertically is smaller than that when arranging the substrate 14 horizontally, even if the communication device 5 is arranged at any of the various positions on the attachment member 6.

Regarding the luminaire 10, the communication device 5 is arranged adjacent to the power supply 4 (P2 in FIG. 4), and also the substrate 14 is arranged so that the surface thereof is perpendicular to the bottom plate 16. That is, in the luminaire 10, the substrate 14 is arranged so that the thickness direction of the substrate 14 is orthogonal to the thickness direction of the communication substrate 13. The antenna 12 formed on the substrate 14 is provided to extend in a vertical direction to the bottom plate 16, and arranged so as to strongly radiate a polarized wave parallel to the side plates 17A and 17B paired. In other words, the antenna 12 is arranged so as to strongly radiate a polarized wave perpendicular to the bottom plate 16 (for example, a vertical polarization).

The luminaire 10 described above includes: the light source 3 having the light-emitting element 8; and the communication device 5 configured to transmit and/or receive the communication signal by the wireless communication. The luminaire 10 further includes: the power supply 4 configured to supply electric power to the light source 3 and the communication device 5; and the housing 34 configured to contain the communication device 5 and the power supply 4. The light source 3 is configured to be held by the housing 34. The housing 34 is provided with the opening 35. The housing 34 is formed in the rectangular parallelepiped shape with the plate member having electrical conductivity. The housing 34 is set to have the dimension W1 in the width direction thereof such that the radio frequency of the communication signal is equal to or more than the cutoff frequency. Accordingly, the luminaire 10 can more improve the flexible arrangement for the communication device 5, compared to each luminaire in the illuminating system described in the above Document 1. Even if the communication device 5 is arranged apart from the opening 35, the luminaire 10 can better prevent deterioration in the communication performance, compared to each luminaire in the illuminating system described in the above Document 1. That is, the luminaire 10 can improve the flexible arrangement for the communication device and further prevent the deterioration in the communication performance.

It is preferable that the dimension W1 in the width direction, of the housing 34, be set to 0.06 [m] or more, when the radio frequency of the communication signal is within the 2.4 GHz band. Alternatively, it is preferable that the dimension W1 in the width direction, of the housing 34, be set to 0.16 [m] or more, when the radio frequency of the communication signal is within the 920 MHz band. Accordingly, it is possible to cause the housing 34 to function more effectively as the waveguide which propagates the communication signal, and further prevent the deterioration in the communication performance.

It is preferable that the housing 34 be formed as a metallic hollow waveguide. Also it is preferable that the dimension W1 in the width direction, of the housing 34, is set larger than the dimension T1 in the thickness direction, of the housing 34.

It is preferable that the opening 35 have the slit-like opening shape. Accordingly, the periphery of the opening 35 can serve as the slot antenna for the waveguide (the housing 34) in the luminaire 10. As a result, the luminaire 10 can further prevent deterioration in the communication performance.

The opening 35 is preferably set to have the dimension L1 in the longitudinal direction that is equal to or more than $\frac{1}{2}\lambda c$ when the cutoff wavelength of the cutoff frequency is $\lambda c$. Accordingly, the periphery of the opening 35 can appropriately function as the slot antenna in the luminaire 10. The opening 35 is preferably set to have the dimension L1 in the longitudinal direction that is $\frac{1}{2}\lambda c$.

The opening 35 includes at least the first opening 35A and the second opening 35B, and it is preferable that the first opening 35A and the second opening 35B be respectively arranged in the both ends in the width direction, of the housing 34. Accordingly, the luminaire 10 can further prevent deterioration in the communication performance. It is more preferable that the longitudinal directions of the first opening 35A and the second opening 35B be parallel to the longitudinal direction of the housing 34.

As described above, the luminaire 10 preferably includes the light source unit 1 and the luminaire body 2 to which the light source unit 1 is attached. The light source unit 1 preferably includes the light source 3, the communication device 5, the power supply 4, and the attachment member 6 to which the light source 3, the communication device 5 and the power supply 4 are attached. The luminaire body 2 and the attachment member 6 are preferably formed with the metal plates. The luminaire body 2 is preferably provided with the recess 22 in which the attachment member 6 is arranged. The housing 34 is preferably configured by the attachment member 6 and the recess 22. Accordingly, the luminaire 10 can more improve the flexible arrangement for the communication device 5, compared to each luminaire in the illuminating system described in the above Document 1. Even if the communication device 5 is arranged apart from the opening 35, the luminaire 10 can more prevent deterioration in the communication performance, compared to each luminaire in the illuminating system described in the above Document 1. That is, the luminaire 10 can improve the flexible arrangement for the communication device and prevent deterioration in the communication performance.

As described above, it is preferable that the attachment member 6 include: the bottom plate 16 in the rectangular shape; and the side plates 17A and 17B which are paired and protruded at the both ends of the bottom plate 16 in the one direction orthogonal to the thickness direction of the bottom plate 16. It is preferable that the opening 35 be provided between the inner peripheral wall 28 of the recess 22 and each of the side plates 17A and 17B paired. Accordingly, in the luminaire 10, for example, the communication signal from the communication device 5 can be transmitted through the opening 35 of the housing 34 serving as the waveguide. Therefore, the luminaire 10 can prevent deterioration in the communication performance. As shown in FIG. 3, it is more preferable that the longitudinal direction of the opening 35 be parallel to the longitudinal direction of the housing 34.

As described above, it is preferable that the communication device 5 include the antenna 12 for transmitting and/or receiving the communication signal and the communication substrate 13 having the communication circuit electrically connected to the antenna 12. As described above, the housing 34 preferably has the outer peripheral shape of the rectangular. It is preferable that the antenna 12 be arranged so as to strongly radiate the polarized wave parallel to the side plates 17A and 17B paired. Accordingly, for example in the luminaire 10, compared with when the thickness direction of the substrate 14 is the same as the thickness direction of the communication substrate 13, the radiation intensity ratio of the radio wave from the communication device 5 can be improved. That is, the luminaire 10 can more improve the communication performance, compared with the case where the thickness direction of the substrate 14 is the same as the thickness direction of the communication substrate 13.

As described above, it is preferable that the antenna 12 be provided to extend in the vertical direction to the bottom plate 16 of the attachment member 6. Accordingly, the communication performance can be more improved.

Embodiment 2

Figure 8:
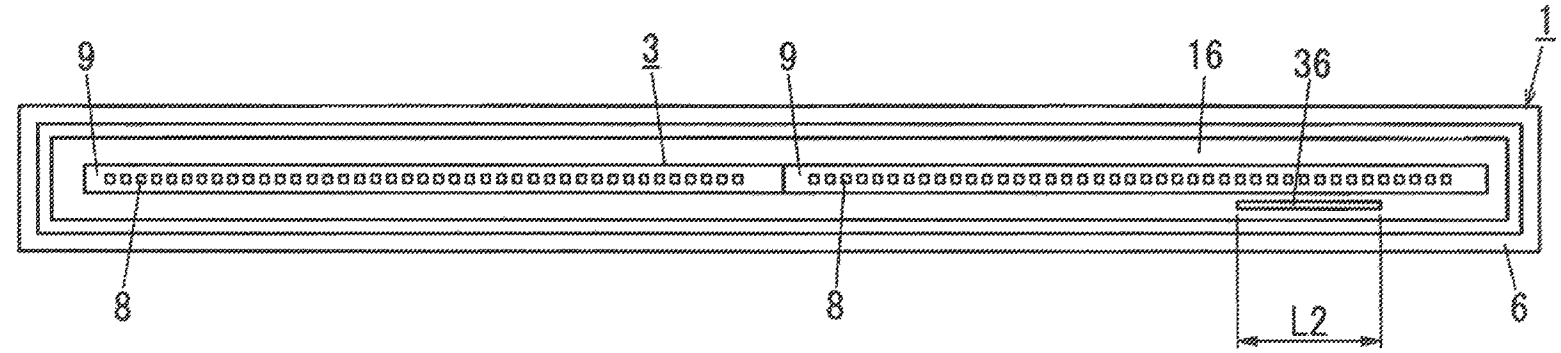
FIG. 8 is a schematic plan view of a light source unit from which a cover is removed in a luminaire according to Embodiment 2.

A basic configuration of a luminaire 10 of Embodiment 2 is a same as that of a luminaire 10 of Embodiment 1. However, the luminaire 10 of Embodiment 2 is different from the luminaire 10 of Embodiment 1 in that instead of an opening 35 provided between an inner peripheral wall 28 of a recess 22 and each of side plates 17A and 17B paired, an opening 36 is provided in a bottom plate 16, as shown in FIG. 8. Note that, in the luminaire 10 of Embodiment 2, same components are denoted by same signs as the luminaire 10 of Embodiment 1, and explanations thereof will be appropriately omitted.

The opening 36 with a slit-like shape is formed in the bottom plate 16 in the luminaire 10 of Embodiment 2. The opening 36 is set to have a dimension L2 (refer to FIG. 8) in a longitudinal direction that is equal to or more than ½λc when a cutoff wavelength of the cutoff frequency is λc, similarly to the opening 35 in Embodiment 1. Accordingly, a periphery of the opening 36 can serve as a slot antenna for a waveguide (a housing 34) in the luminaire 10 of Embodiment 2. For example in the luminaire 10 of Embodiment 2, a communication signal from an antenna 12 of a communication device 5 can be transmitted through the opening 36 serving as the slot antenna. As a result, deterioration in communication performance can be further prevented in the luminaire 10 of Embodiment 2.

In the luminaire 10 of Embodiment 2 described above, an attachment member 6 includes: the bottom plate 16 formed into a rectangular shape; and the side plates 17A and 17B which are paired and protruded at both ends of the bottom plate 16 in one direction orthogonal to a thickness direction of the bottom plate 16. The opening 36 is provided in the bottom plate 16. Accordingly, for example in the luminaire 10 of Embodiment 2, a communication signal from the communication device 5 can be transmitted through the opening 36 of the bottom plate 16 in the housing 34 serving as the waveguide. Therefore, the luminaire 10 of Embodiment 2 can prevent deterioration in the communication performance.

As described above, it is preferable that the opening 36 have a slit-like opening shape. Accordingly, the periphery of the opening 36 can serve as the slot antenna for the waveguide (the housing 34) in the luminaire 10 of Embodiment 2. As a result, deterioration in the communication performance can be further prevented in the luminaire 10 of Embodiment 2. Note that it is more preferable that the longitudinal direction of the opening 36 be parallel to a longitudinal direction of the housing 34.

As apparent from Embodiments 1 and 2 described above, a luminaire (10) of a first aspect according to the present disclosure includes: a light source (3) having a light-emitting element (8); a communication device (5) configured to transmit and/or receive a communication signal by wireless communication; a power supply (4) configured to supply electric power to the light source (3) and the communication device (5); and a housing (34) configured to contain the communication device (5) and the power supply (4). The light source (3) is configured to be held by the housing (34). The housing (34) is provided with an opening (35, 36). The housing (34) has a rectangular parallelepiped shape with electrically conductive walls to form a rectangular waveguide having a cutoff frequency. The housing (34) is set to have a dimension (W1) in a width direction thereof such that a radio frequency of the communication signal is equal to or more than the cutoff frequency.

Regarding a luminaire (10) of a second aspect according to the present disclosure, in the first aspect, the dimension (W1) in the width direction, of the housing (34), is set to 0.06 [m] or more, when the radio frequency of the communication signal is within a 2.4 GHz band.

Regarding a luminaire (10) of a third aspect according to the present disclosure, in the first aspect, the dimension (W1) in the width direction, of the housing (34), is set to 0.16 [m] or more, when the radio frequency of the communication signal is within a 920 MHz band.

Regarding a luminaire (10) of a fourth aspect according to the present disclosure, in the first aspect, the housing (34) is formed as a metallic hollow waveguide.

Regarding a luminaire (10) of a fifth aspect according to the present disclosure, in the first aspect, the dimension (W1) in the width direction, of the housing (34), is set larger than a dimension (T1) in a thickness direction, of the housing (34).

Regarding a luminaire (10) of a sixth aspect according to the present disclosure, in the first aspect, the opening (35, 36) has a slit-like opening shape.

Regarding a luminaire (10) of a seventh aspect according to the present disclosure, in the sixth aspect, the opening (35, 36) is set to have a dimension (L1, L2) in a longitudinal direction that is equal to or more than ½λc when a cutoff wavelength of the cutoff frequency is λc.

Regarding a luminaire (10) of an eighth aspect according to the present disclosure, in any one of the first to seventh aspects, the opening (35) includes at least a first opening (35A) and a second opening (35B), and the first opening and the second opening (35A, 35B) are respectively arranged in both ends in the width direction, of the housing (34).

Regarding a luminaire (10) of a ninth aspect according to the present disclosure, in the eighth aspect, longitudinal directions of the first opening and the second opening (35A, 35B) are parallel to a longitudinal direction of the housing (34).

A luminaire (10) of a tenth aspect according to the present disclosure, in any one of the first to seventh aspects, includes a light source unit (1) and a luminaire body (2) to which the light source unit (1) is attached. The light source unit (1) includes the light source (3), the communication device (5), the power supply (4), and an attachment member (6) to which the light source (3), the communication device (5) and the power supply (4) are attached. The luminaire body (2) and the attachment member (6) are formed with metal plates. The luminaire body (2) is provided with a recess (22) in which the attachment member (6) is arranged. The housing (34) is configured by the attachment member (6) and the recess (22).

Regarding a luminaire (10) of an eleventh aspect according to the present disclosure, in the tenth aspect, the attachment member (6) includes: a bottom plate (16) in a rectangular shape; and side plates (17A, 17B) which are paired and protruded at both ends of the bottom plate (16) in one direction orthogonal to a thickness direction of the bottom plate (16). The opening (35, 36) is provided between an inner peripheral wall (28) of the recess (22) and each of the side plates (17A, 17B) paired, or in the bottom plate (16).

Regarding a luminaire (10) of a twelfth aspect according to the present disclosure, in the eleventh aspect, a longitudinal direction of the opening (35, 36) is parallel to a longitudinal direction of the housing (34).

Regarding a luminaire (10) of a thirteenth aspect according to the present disclosure, in the eleventh or twelfth aspect, the communication device (5) includes: an antenna (12) for transmitting and/or receiving the communication signal; and a communication substrate (13) having a communication circuit electrically connected to the antenna (12). The housing (34) has an outer peripheral shape of a rectangular. The antenna (12) is arranged so as to strongly radiate a polarized wave parallel to the side plates (17A, 17B) paired.

Regarding a luminaire (10) of a fourteenth aspect according to the present disclosure, in the thirteenth aspect, the antenna (12) is provided to extend in a vertical direction to the bottom plate (16) of the attachment member (6).

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A luminaire, comprising:

a light source having a light-emitting element;

a communication device having an antenna and configured to transmit or receive a communication signal by wireless communication;

a power supply configured to supply electric power to the light source and the communication device;

a housing configured to contain the communication device and the power supply; and a cover, wherein the light source is configured to be held by the housing, the housing is provided with an opening, the housing has a rectangular parallelepiped shape with electrically conductive walls to form a rectangular waveguide which propagates the communication signal transmitted or received by the communication device by wireless communication, the waveguide having a cutoff frequency, and the housing is set to have a dimension in a width direction thereof such that a radio frequency of the communication signal is equal to or more than the cutoff frequency, wherein the opening comprises at least a first opening and a second opening such that the communication signal from the antenna is transmitted through the first opening and the second opening of the housing serving as the waveguide that propagates the communication signal, and the first opening and the second opening are respectively arranged in a first end and a second end in the width direction, of the housing, wherein the cover covers at least the light source, the first opening and the second opening.

2. The luminaire of claim 1, wherein the dimension in the width direction, of the housing, is set to 0.06 [m] or more, when the radio frequency of the communication signal is within a 2.4 GHz band.

3. The luminaire of claim 1, wherein the dimension in the width direction, of the housing, is set to 0.16 [m] or more, when the radio frequency of the communication signal is within a 920 MHz band.

4. The luminaire of claim 1, wherein the housing is formed as a metallic hollow waveguide.

5. The luminaire of claim 1, wherein the dimension in the width direction, of the housing, is set larger than a dimension in a thickness direction, of the housing.

6. The luminaire of claim 1, wherein the opening has a slit-like opening shape.

7. The luminaire of claim 6, wherein the opening is set to have a dimension in a longitudinal direction that is equal to or more than ½λc when a cutoff wavelength of the cutoff frequency is λc.

8. The luminaire of claim 1, wherein longitudinal directions of the first opening and the second opening are parallel to a longitudinal direction of the housing.

9. The luminaire of claim 1, comprising:

a light source unit; and a luminaire body to which the light source unit is attached, wherein the light source unit comprises the light source, the communication device, the power supply, and an attachment member to which the light source, the communication device and the power supply are attached, the luminaire body and the attachment member are formed with metal plates, the luminaire body is provided with a recess in which the attachment member is arranged, and the housing is configured by the attachment member and the recess.

10. The luminaire of claim 9, wherein the attachment member comprises: a bottom plate in a rectangular shape; and side plates which are paired and protruded at both ends of the bottom plate in one direction orthogonal to a thickness direction of the bottom plate, and the opening is provided between an inner peripheral wall of the recess and each of the side plates paired, or in the bottom plate.

11. The luminaire of claim 10, wherein a longitudinal direction of the opening is parallel to a longitudinal direction of the housing.

12. The luminaire of claim 10, wherein the communication device comprises a communication substrate having a communication circuit electrically connected to the antenna, the housing has an outer peripheral shape of a rectangle, and the antenna is arranged so as to radiate a polarized wave parallel to the side plates paired.

13. The luminaire of claim 11, wherein the communication device comprises a communication substrate having a communication circuit electrically connected to the antenna, the housing has an outer peripheral shape of a rectangle, and the antenna is arranged so as to radiate a polarized wave parallel to the side plates paired.

14. The luminaire of claim 12, wherein the antenna is provided to extend in a vertical direction to the bottom plate of the attachment member.

15. The luminaire of claim 13, wherein the antenna is provided to extend in a vertical direction to the bottom plate of the attachment member.

16. A luminaire, comprising:

a light source unit; and a luminaire body to which the light source unit is attached, wherein the light source unit comprises:

a light source having a light-emitting element;

a communication device including an antenna configured to transmit or receive a communication signal by wireless communication;

a power supply configured to supply electric power to the light source and the communication device; and an attachment member to which the light source, the communication device and the power supply are attached, wherein the luminaire body and the attachment member are formed with metal plates, the luminaire body is provided with a recess in which the attachment member is arranged, and the attachment member and the recess forms a housing, wherein the housing is configured to contain the communication device and the power supply, the light source is configured to be held by the housing, the housing is provided with an opening, the housing has a rectangular parallelepiped shape with electrically conductive walls to form a rectangular waveguide which propagates the communication signal transmitted or received by the communication device by wireless communication, the waveguide having a cutoff frequency, and the housing is set to have a dimension in a width direction thereof such that a radio frequency of the communication signal is equal to or more than the cutoff frequency, wherein the attachment member comprises: a bottom plate in a rectangular shape; and side plates which are paired and protruded at both ends of the bottom plate in one direction orthogonal to a thickness direction of the bottom plate, and the opening is provided between an inner peripheral wall of the recess and each of the side plates paired.

* * * * *